US009532603B2

(12) United States Patent
Plojoux et al.

(10) Patent No.: US 9,532,603 B2
(45) Date of Patent: Jan. 3, 2017

(54) AEROSOL GENERATING DEVICE AND SYSTEM WITH IMPROVED AIRFLOW

(71) Applicant: Philip Morris Products S.A., Neuchatel (CH)

(72) Inventors: Julien Plojoux, Geneva (CH); Olivier Greim, Villars-Burquin (CH); Yvan Degoumois, Colombier (CH); Dani Ruscio, Cressier (CH)

(73) Assignee: Philip Morris Products S.A., Neuchatel (CH)

( * ) Notice: Subject to any disclaimer, the term of this patent is extended or adjusted under 35 U.S.C. 154(b) by 185 days.

(21) Appl. No.: 14/370,410

(22) PCT Filed: Dec. 28, 2012

(86) PCT No.: PCT/EP2012/077065
§ 371 (c)(1),
(2) Date: Jul. 2, 2014

(87) PCT Pub. No.: WO2013/102609
PCT Pub. Date: Jul. 11, 2013

(65) Prior Publication Data

US 2014/0338686 A1 Nov. 20, 2014

(30) Foreign Application Priority Data

| | | |
|---|---|---|
| Jan. 3, 2012 | (EP) | 12150114 |
| Feb. 13, 2012 | (EP) | 12155245 |
| Sep. 11, 2012 | (EP) | 12183828 |

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

| | | | |
|---|---|---|---|
| 1,674,617 | A | 6/1928 | De Benedictis |
| 4,638,820 | A | 1/1987 | Roberts et al. |

(Continued)

FOREIGN PATENT DOCUMENTS

| | | | |
|---|---|---|---|
| CN | 1039710 | A | 2/1990 |
| CN | 1633247 | A | 6/2005 |

(Continued)

OTHER PUBLICATIONS

International Preliminary Report on Patentability issued Aug. 14, 2014 in PCT/EP2012/077065.

(Continued)

*Primary Examiner* — Michael J Felton
(74) *Attorney, Agent, or Firm* — Oblon, McClelland, Maier & Neustadt, L.L.P.

(57) ABSTRACT

An aerosol generating system includes an aerosol-forming article including an aerosol-forming substrate and a mouthpiece portion for allowing a user to draw air through the substrate; and an aerosol generating device, the device including a housing having proximal and distal ends and including at least one external surface and one internal surface, the internal surface defining an open ended cavity at the proximal end of the housing in which the substrate is received, the cavity having a longitudinal extent between its proximal and distal ends, a heater element within the cavity configured to heat the substrate received in the cavity, and an air inlet; the system including a first air flow channel extending from the air inlet to a distal end of the cavity, wherein the first channel extends between the heater and the external surface of the housing along at least a portion of the longitudinal extent of the cavity, and a second air flow channel extending from the distal end of the cavity to the mouthpiece portion.

14 Claims, 3 Drawing Sheets

(56) References Cited

U.S. PATENT DOCUMENTS

| | | | | |
|---|---|---|---|---|
| 4,898,190 | A | 2/1990 | Deal | |
| 4,949,736 | A | 8/1990 | Roberts et al. | |
| 5,144,962 | A | 9/1992 | Counts et al. | |
| 5,388,594 | A | 2/1995 | Counts et al. | |
| 5,505,214 | A * | 4/1996 | Collins | A24F 47/008 128/202.21 |
| 5,665,262 | A | 9/1997 | Hajaligol et al. | |
| 5,750,964 | A | 5/1998 | Counts et al. | |
| 5,954,979 | A * | 9/1999 | Counts | A24F 47/008 131/194 |
| 2003/0154991 | A1 | 8/2003 | Fournier et al. | |
| 2008/0021072 | A1 | 1/2008 | Luzenberg | |
| 2010/0313901 | A1 | 12/2010 | Fernando et al. | |

FOREIGN PATENT DOCUMENTS

| | | | |
|---|---|---|---|
| CN | 101862038 | A | 10/2010 |
| EP | 0 430 559 | | 6/1991 |
| EP | 1 025 397 | B1 | 5/2004 |
| EP | 2 052 753 | A1 | 4/2009 |
| EP | 2 327 318 | A1 | 6/2011 |
| FR | 2 354 720 | | 1/1978 |
| GB | 741 101 | | 11/1955 |
| GB | 2 301 040 | A | 11/1996 |
| GB | 2473264 | | 3/2011 |
| JP | 3-232481 | A | 10/1991 |
| JP | 7-184627 | A | 7/1995 |
| JP | 2001-521123 | A | 11/2001 |
| JP | 2005-517421 | A | 6/2005 |
| JP | 2010-506594 | A | 3/2010 |
| WO | 99 20939 | | 4/1999 |
| WO | WO 2007/042941 | A2 | 4/2007 |
| WO | WO 2010/020634 | A1 | 2/2010 |
| WO | WO 2013/098409 | A1 | 7/2013 |

OTHER PUBLICATIONS

Extended Search Report issued Oct. 26, 2012 in European Patent Application No. 12150114.2.

Extended Search Report issued Oct. 29, 2012 in European Patent Application No. 12155245.9.

Office Action issued Dec. 28, 2012 in Kazakhstan Patent Application No. 2014/1658.1 (submitting English language translation only).

Combined Chinese Office Action and Search Report issued Dec. 30, 2015 in Patent Application No. 201280070578.3 (submitting English language translation only).

International Search Report Issued Feb. 7, 2014 in PCT/EP12/077065 Filed Dec. 28, 2012.

Office Action issued Apr. 15, 2016 in Korean Patent Application No. 10-2014-7019032 (with English language translation).

English translation of Decision to Grant a Patent issued Jun. 6, 2016 in Japanese Patent Application No. 2014-550688.

English translation of Decision of Granting issued Jun. 9, 2016 in Russian Patent Application No. 2014132080.

* cited by examiner

AEROSOL GENERATING DEVICE AND SYSTEM WITH IMPROVED AIRFLOW

CROSS REFERENCE TO RELATED APPLICATION

This application is a national phase application based on PCT/EP2012/077065, filed on Dec. 28, 2012.

The present specification relates to an aerosol generating device that is configured to heat an aerosol-forming substrate and in particular to a design for ensuring beneficial air flow through the device. The invention may advantageously be applied to portable heated smoking systems.

Handheld aerosol generating devices that include a heater for heating aerosol-forming substrates are known in the art. Electrically heated smoking devices are an example of this type of device. Aerosol-forming substrates in electrically heated smoking devices typically need to be heated to temperatures of several hundred degrees centigrade in order to release the volatile compounds that can form an aerosol. The heater is typically located within the housing of the device, at the position of the most natural part to hold during a smoking session. It is therefore this part of the housing that is becomes hottest during use.

It is desirable from a consumer perspective that electrical smoking devices are small and easy to hold, approximating a conventional cigarette in size and shape. One of the challenges with producing a device with such a small diameter is ensuring that the housing is not so hot as to be uncomfortable to hold. For example, where a device is roughly the same size as a conventional cigarette or only sufficiently large to allow receipt of a cigarette sized rod including an aerosol-forming substrate, the device can become uncomfortably hot.

It would be desirable to provide an aerosol generating device suitable for holding in the hand with a comfortable maximum housing temperature during operation. It would also be desirable to provide an aerosol generating device that includes a heater for heating aerosol-forming substrate in which heat loss through a housing of the device is minimised.

In a first aspect of the present disclosure there is provided an aerosol generating system comprising:

an aerosol-forming article comprising an aerosol-forming substrate and a mouthpiece portion for allowing a user to draw air through the substrate; and an aerosol generating device, the device comprising a housing having proximal and distal ends and comprising at least one external surface and one internal surface, the internal surface defining an open ended cavity at the proximal end of the housing in which the aerosol-forming substrate is received, the cavity having a longitudinal extent between its proximal and distal ends, a heater element within the cavity configured to heat an aerosol-forming substrate received in the cavity, and an air inlet;

wherein the system comprises a first air flow channel extending from the air inlet to a distal end of the cavity, wherein the first air flow channel extends between the heater and the external surface of the housing along at least a portion of the longitudinal extent of the cavity, and a second air flow channel extending from the distal end of the cavity to the mouthpiece portion.

The aerosol-generating system may be a handheld electrically heated smoking system.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth. An aerosol-generating device may be a holder.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article or smoking article.

As used herein, the terms 'aerosol-generating article' and 'smoking article' refer to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable. The term 'smoking article' is generally used hereafter. A smoking article may be, or may comprise, a tobacco stick.

As used herein, the term 'aerosol generating system' refers to a combination of an aerosol-generating device and one or more aerosol-generating articles for use with the device. An aerosol-generating system may include additional components, such as for example a charging unit for recharging an on-board electric power supply in an electrically operated or electric aerosol-generating device.

As used herein the term 'mouthpiece portion' refers to a portion of an aerosol-generating article that is placed into a user's mouth in order to directly inhale an aerosol generated by the aerosol-generating article or aerosol-generating device. The aerosol is conveyed to the user's mouth through the mouthpiece.

By drawing ambient air along the exterior of the cavity in which the aerosol-forming substrate is heated but within the housing, heat lost from the cavity is drawn away from the exterior surface of the housing. In effect, the incoming air cools the exterior surface of the housing by removing excess heat before it reaches the exterior of the housing. This is beneficial as it ensures that the exterior of the housing in the region of the cavity is comfortable to hold during use of the system.

This arrangement also provides pre-heating of the air that is used in the generation and transport of aerosol within the device, reducing the amount of energy required to be delivered to the heater, making the device more efficient, and providing a more uniform temperature distribution within the aerosol-forming substrate.

A further advantage to this arrangement is that the first airflow channel extending along a least a portion of the cavity reduces the amount of side stream aerosol (which is aerosol that escapes from the device rather than being delivered to the user) when compared to system in which air is drawn directly from the exterior of the device into a heated cavity. Side stream aerosol can be a significant issue during periods when the user is not drawing air through the inlet channel.

The first air flow channel may be positioned between the internal surface and the external surface. Alternatively, or in addition, the first air flow channel may be between the internal surface and the aerosol-forming substrate.

The device may comprise a plurality of air inlets. The number and size of the air flow inlets may be chosen to provide a desired resistance to draw through the device. In an electrical smoking device it may be desirable for the resistance to draw (RTD) through the device and substrate to be close to the resistance to draw of a conventional cigarette.

Resistance to draw is also known as draft resistance, draw resistance, puff resistance or puffability, and is the pressure required to force air through the full length of the object under test at the rate of 17.5 ml/sec at 22° C. and 760 Torr (101 kPa). It is typically expressed in units of $mmH_2O$ and is measured in accordance with ISO 6565:2011. The aerosol-forming article and the aerosol generating device advantageously together provide an RTD of between 80 and 120 $mmH_2O$ through the first and second air flow channels. This approximates the RTD of a conventional cigarette. The aerosol-forming device, without an aerosol-forming article coupled to it, may advantageously have an RTD of between 5 and 20 $mmH_2O$. The aerosol-forming article in isolation may have an RTD of between 40 and 80 $mmH_2O$.

The aerosol generating device advantageously provides greater than 10% of the RTD through the first and second air flow channels. This allows the aerosol-forming article to be made with an RTD of significantly lower than that of a conventional cigarette while the system as a whole provides an RTD that mimics a conventional cigarette. In electrically heated smoking systems less tobacco containing substrate is typically needed than in a conventional, combustible cigarette to provide the same length and number of puffs. This means that the smoking article can be made shorter, resulting in a lower RTD than a conventional cigarette. By using a device that provides a significant RTD, no additional components are required in the smoking article to increase the RTD of the smoking article. This keeps the cost of each smoking article as low as possible.

If a plurality of air inlets is provided, they may be spaced around the circumference of the cavity to provide a uniform thermal profile for the housing and substrate. The total cross sectional area of the air inlets is advantageously between 3 and 5 $mm^2$.

The air inlet or inlets may be at or close to a proximal end of the cavity. Close to a proximal end in this context means closer to the proximal end than to the distal end. The first air flow channel then extends along the majority of the longitudinal extent of the cavity, providing extended thermal contact between the air flow channel and the cavity. A further advantage of positioning the air inlet at a proximal end of the cavity is that it is unlikely to be blocked by the hand of a user during use. The air inlet may be provided in a proximal face of the housing to minimise the risk of blockage by a user. The first air flow channel may extend a length at least as great as the longitudinal extent of the heater element within the cavity, and may extend substantially the entire length of the cavity. This provides cooling of the housing over the entire extent of the heater element within the cavity.

The first air flow channel may be linear, extending straight from the air inlet or inlets to the distal end of the cavity. However, the first air flow channel may be formed in any shape, such as a helical shape or a serpentine shape. Different shaped air flow paths may be used to provide for different thermal profiles and to match other aspects of the device, such as the shape of the cavity and the heater. For example, if the heater element is formed as a helical heating element extending around the cavity, the first air flow channel may be formed in a corresponding helical shape outside the heater element. At least a portion of the first air flow channel may extend parallel to a longitudinal extent of the heater element.

If a plurality of air inlets is provided, they may be in fluid communication with a single first air flow channel substantially surrounding the cavity. This provides an air flow that substantially surrounds substrate, reducing the chances of an uneven temperature distribution on the exterior of the housing. The single first air flow channel may be in fluid communication with one air outlet or a plurality of air outlets at a distal end of the cavity.

A distal end of the first airflow channel and a distal end of the second airflow channel may meet at an air outlet. The air outlet may be positioned around a distal end of the heater element. For example, the heater element may be a pin or blade heater that extends into the aerosol-forming substrate. The air outlet may be positioned around a base of the pin or blade to efficiently convect heat throughout the substrate. The outlet and substrate may be configured to give rise to laminar air flow through the substrate during normal operation.

The housing may comprise a main body and a substrate holder portion, the substrate holder portion being separable from the main body and comprising at least a portion of the internal wall. The substrate holder portion may be provided to improve the insertion and removal of aerosol-forming substrates to and from the device. The air inlet may be formed in the substrate holder portion. The air outlet may be formed in the substrate holder portion.

The heater element may be configured to heat an aerosol-forming substrate continuously during operation of the device. "Continuously" in this context means that heating is not dependent on air flow through the device so that power may be delivered to the heater element even when there is no airflow through the device. Cooling the housing of the device is particularly desirable in continuously heated systems as the temperature of the housing may rise in periods when power is being supplied to the heater element but air is not being drawn through the device. Alternatively, the device may include means to detect air flow and the heater element may be configured to heat the aerosol-forming substrate only when the air flow exceeds a threshold level, indicative of a user drawing on the device.

The device may include an air inlet adjustment element, allowing the size of the air inlet to be adjusted. For example, the adjustment mechanism may be a shell coupled to the exterior of the housing having an aperture. Rotation or translation of the shell on the housing may block (fully or partially) one or more openings on the housing forming the air inlet or inlets. This provides the ability for the user to adjust the device according to his or her preference.

The device is preferably a portable or handheld device that is comfortable to hold between the fingers of a single hand. The device may be substantially cylindrical in shape and has a length of between 70 and 120 mm. The maximum diameter of the device is preferably between 10 and 20 mm. In one embodiment the device has a polygonal cross section and has a protruding button formed on one face. In this embodiment, the diameter of the device is between 12.7 and 13.65 mm taken from a flat face to an opposing flat face; between 13.4 and 14.2 taken from an edge to an opposing edge (i.e., from the intersection of two faces on one side of the device to a corresponding intersection on the other side), and between 14.2 and 15 mm taken from a top of the button to an opposing bottom flat face.

The heater element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum, platinum, gold and silver. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Alternatively, the electric heaters may comprise an infra-red heating element, a photonic source, or an inductive heating element.

The aerosol-generating device may comprise an internal heater element or an external heater element, or both internal and external heater elements, where "internal" and "external" refer to the aerosol-forming substrate. An internal heater may take any suitable form. For example, an internal heater may take the form of a heating blade. Alternatively, the internal heater may take the form of a casing or substrate having different electro-conductive portions, or an electrically resistive metallic tube. Alternatively, the internal heater may be one or more heating needles or rods that run through the centre of the aerosol-forming substrate. Other alternatives include a heating wire or filament, for example a Ni—Cr (Nickel-Chromium), platinum, tungsten or alloy wire or a heating plate. Optionally, the internal heating element may be deposited in or on a rigid carrier material. In one such embodiment, the electrically resistive heater may be formed using a metal having a defined relationship between temperature and resistivity. In such an exemplary device, the metal may be formed as a track on a suitable insulating material, such as a ceramic material like Zirconia, and then sandwiched in another insulating material, such as a glass. Heaters formed in this manner may be used to both heat and monitor the temperature of the heaters during operation.

An external heater may take any suitable form. For example, an external heater may take the form of one or more flexible heating foils on a dielectric substrate, such as polyimide. The flexible heating foils can be shaped to conform to the perimeter of the substrate receiving cavity. Alternatively, an external heater may take the form of a metallic grid or grids, a flexible printed circuit board, a moulded interconnect device (MID), ceramic heater, flexible carbon fibre heater or may be formed using a coating technique, such as plasma vapour deposition, on a suitable shaped substrate. An external heater may also be formed using a metal having a defined relationship between temperature and resistivity. In such an exemplary device, the metal may be formed as a track between two layers of suitable insulating materials. An external heater formed in this manner may be used to both heat and monitor the temperature of the external heater during operation.

The internal or external heater may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. In one embodiment, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy. The heat sink or heat reservoir may be arranged such that it is directly in contact with the aerosol-forming substrate and can transfer the stored heat directly to the substrate. Alternatively, the heat stored in the heat sink or heat reservoir may be transferred to the aerosol-forming substrate by means of a heat conductor, such as a metallic tube.

The heater element may heat the aerosol-forming substrate by means of conduction. The heater element may be at least partially in contact with the substrate, or the carrier on which the substrate is deposited. Alternatively, the heat from either an internal or external heater element may be conducted to the substrate by means of a heat conductive element.

The aerosol-forming article may be a smoking article. During operation a smoking article containing the aerosol-forming substrate may be partially contained within the aerosol-generating device.

The smoking article may be substantially cylindrical in shape. The smoking article may be substantially elongate. The smoking article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The smoking article may have a total length between approximately 30 mm and approximately 100 mm. The smoking article may have an external diameter between approximately 5 mm and approximately 12 mm. The smoking article may comprise a filter plug. The filter plug may be located at a downstream end of the smoking article. The filter plug may be a cellulose acetate filter plug. The filter plug is approximately 7 mm in length in one embodiment, but may have a length of between approximately 5 mm to approximately 10 mm.

In one embodiment, the smoking article has a total length of approximately 45 mm. The smoking article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The smoking article may comprise an outer paper wrapper. Further, the smoking article may comprise a separation between the aerosol-forming substrate and the filter plug. The separation may be approximately 18 mm, but may be in the range of approximately 5 mm to approximately 25 mm.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former that facilitates the formation of a dense and stable aerosol. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise comminuting one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

In a particularly preferred embodiment, the aerosol-forming substrate comprises a gathered crimped sheet of homogenised tobacco material. As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

Although reference is made to solid aerosol-forming substrates above, it will be clear to one of ordinary skill in the art that other forms of aerosol-forming substrate may be used with other embodiments. For example, the aerosol-forming substrate may be a liquid aerosol-forming substrate. If a liquid aerosol-forming substrate is provided, the aerosol-generating device preferably comprises means for retaining the liquid. For example, the liquid aerosol-forming substrate may be retained in a container. Alternatively or in addition, the liquid aerosol-forming substrate may be absorbed into a porous carrier material. The porous carrier material may be made from any suitable absorbent plug or body, for example, a foamed metal or plastics material, polypropylene, terylene, nylon fibres or ceramic. The liquid aerosol-forming substrate may be retained in the porous carrier material prior to use of the aerosol-generating device or alternatively, the liquid aerosol-forming substrate material may be released into the porous carrier material during, or immediately prior to use. For example, the liquid aerosol-forming substrate may be provided in a capsule. The shell of the capsule preferably melts upon heating and releases the liquid aerosol-forming substrate into the porous carrier material. The capsule may optionally contain a solid in combination with the liquid.

Alternatively, the carrier may be a non-woven fabric or fibre bundle into which tobacco components have been incorporated. The non-woven fabric or fibre bundle may comprise, for example, carbon fibres, natural cellulose fibres, or cellulose derivative fibres.

The aerosol-generating device may further comprise a power supply for supplying power to the internal and external heaters. The power supply may be any suitable power supply, for example a DC voltage source such as a battery. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

In another aspect of the disclosure, there is provided an aerosol generating device forming part of the system of the first aspect of the invention. In particular, there is provided an aerosol generating device comprising:

a housing having proximal and distal ends and comprising at least one external surface and one internal surface, the internal surface defining an open ended cavity at the proximal end of the housing in which the aerosol-forming substrate is received, the cavity having a longitudinal extent between its proximal and distal ends, a heater element within the cavity configured to heat an aerosol-forming substrate received in the cavity, an air inlet, a first air flow channel extending from the air inlet to a distal end of the cavity, wherein the first air flow channel extends between the internal surface and the external surface of the housing along at least a portion of the longitudinal extent of the cavity, and a second air flow channel extending from the distal end of the cavity to the proximal end of the cavity.

The device advantageously provides a resistance to draw (RTD) of between 5 and 20 $mmH_2O$ through the first and second air flow channels in the absence of an aerosol forming substrate in the cavity.

In a further aspect of the disclosure, there is provided a method of generating an aerosol from an aerosol-forming substrate comprising:

heating the aerosol-forming substrate; and drawing air along a first air flow path external to the substrate extending from a proximal end to a distal end of the substrate, and from the first air flow path to a second air flow path internal to the substrate extending from the distal end to the proximal end of the substrate.

Although the disclosure has been described by reference to different aspects, it should be clear that features described in relation to one aspect of the disclosure may be applied to the other aspects of the disclosure. In particular, aspects of a device forming part of a system in accordance with one aspect of the invention may be applied to a device alone in accordance with another aspect of the invention.

Examples of the invention will now be described in detail with reference to the accompanying drawings, in which.

Figure 1:
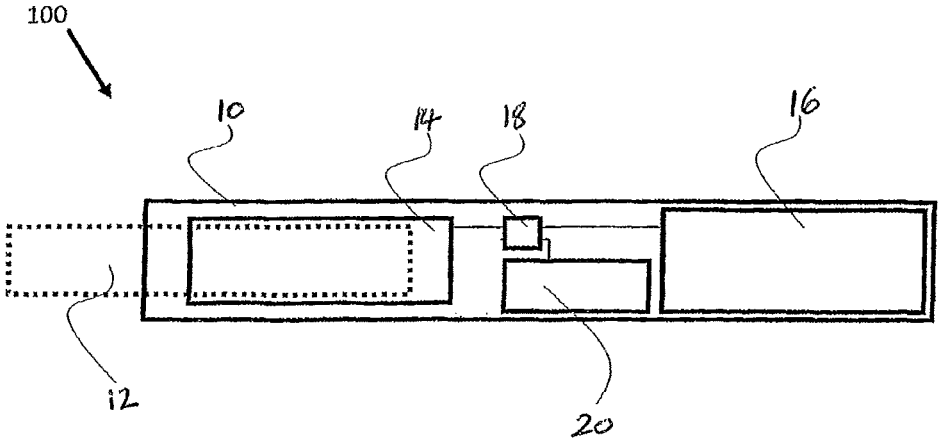
FIG. 1 is a schematic diagram of an aerosol generating device.

In FIG. 1, the components of an embodiment of an electrically heated aerosol generating system 100 are shown in a simplified manner. Particularly, the elements of the electrically heated aerosol generating system 100 are not drawn to scale in FIG. 1. Elements that are not relevant for the understanding of this embodiment have been omitted to simplify FIG. 1.

The electrically heated aerosol generating system 100 comprises a housing 10 and an aerosol-forming substrate 12, for example a cigarette. The aerosol-forming substrate 12 is pushed inside the housing 10 to come into thermal proximity with the heater 14. The aerosol-forming substrate 12 will release a range of volatile compounds at different temperatures. By controlling the maximum operation temperature of the electrically heated aerosol generating system 100 to be below the release temperature of some of the volatile compounds, the release or formation of these smoke constituents can be avoided.

Within the housing 10 there is an electrical energy supply 16, for example a rechargeable lithium ion battery. A controller 18 is connected to the heater 14, the electrical energy supply 16, and a user interface 20, for example a button or display. The controller 18 controls the power supplied to the heater 14 in order to regulate its temperature. Typically the aerosol-forming substrate is heated to a temperature of between 250 and 450 degrees centigrade.

Figure 2:
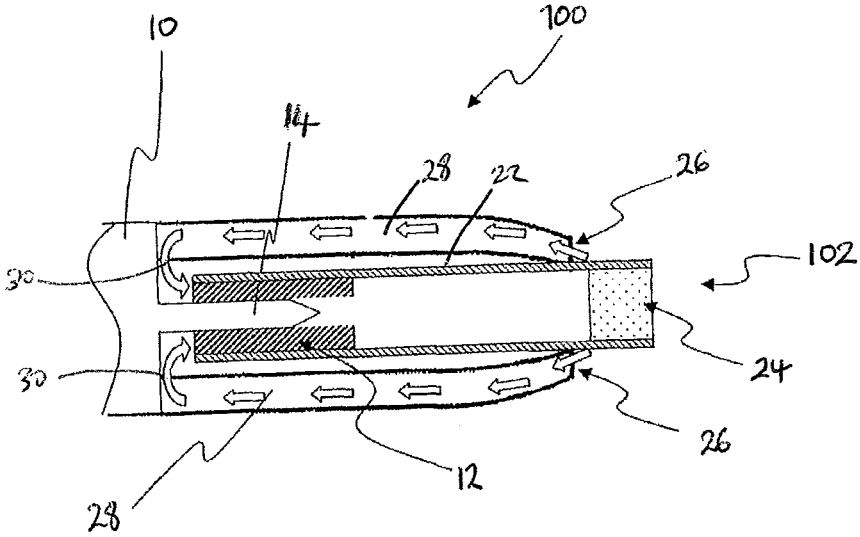
FIG. 2 is a schematic cross-section of a first embodiment of a device of the type shown in FIG. 1, showing the air flow path through the device.

The aerosol-forming substrate requires both heat and air flow through the substrate to generate and deliver aerosol. FIG. 2 is a schematic representation of the air flow through the front or proximal end of the device. It is noted that FIG. 2 does not accurately depict the relative scale of elements of the device, for example the inlet channels. A smoking article 102, including an aerosol forming substrate 12 is received within the cavity 22 of the device 100. Air is drawn into the device by the action of a user sucking on a mouthpiece 24 of the smoking article 102. The air is drawn in through inlets 26 forming in a proximal face of the housing 10. The air drawn into the device passes through an air channel 28 around the outside of the cavity 22. The drawn air enters the aerosol-forming substrate 12 at the distal end of the smoking article 102 adjacent a proximal end of a blade shaped heating element 14 provided in the cavity 22. The drawn air proceeds through the substrate 12, entraining the aerosol, and then to the mouth end of the smoking article 102.

Figure 3:
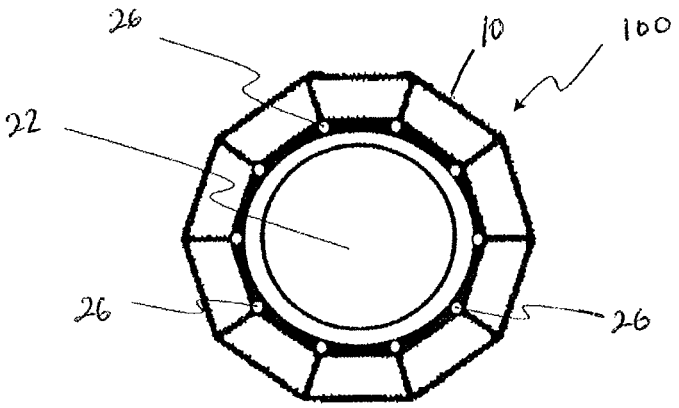
FIG. 3 is a schematic end view of the device of FIG. 2, illustrating air inlets positioned around an end face of the device.

The air inlets 26 are shown schematically in FIG. 3. There is a plurality of inlets spaced around the circumference of the housing. Each of the inlets 26 is in fluid communication with the same internal air flow channel 28 that surrounds the cavity 22. The inlets of FIG. 3 are circular but may be any shape. The size and number of inlets 26 may be chosen by the designer and may be chosen to provide a desired resistance to draw through the device. In addition, means may be provided to adjust the resistance to draw by partially blocking the inlets. For example a rotatable element may be coupled to the proximal face housing 19, with different rotational positions of the rotatable element blocking different numbers of the air inlets.

In the embodiment shown in FIG. 2, the resistance to draw of the system, including the device and the substrate is about 95 $mmH_2O$. The resistance to draw of the device alone, without a substrate is about 13 $mmH_2O$. The resistance to draw was measured in accordance with ISO 6565:2011 which sets out the standard for measurement of draw resistance, using the SODIM pressure drop instrument, which is an instrument specifically designed for measuring the pressure drop across cigarettes and filter rods. The SODIM pressure drop instrument is available from SODIM SAS, 48 Rue Danton, 45404 Fleury-les-Aubrais cedex France. In order to measure the resistance to draw of the device without a substrate, a silicone tube of length 24 mm, diameter 7.8 mm was inserted into the cavity in place of the aerosol-forming article. The resistance to draw, both with and without the aerosol-forming article was measured a plurality of times to provide an average result.

The air inlets are positioned on a front or proximal face of the housing. In this position they are very unlikely to be inadvertently blocked by a user's hand during use. However, in a device in which the user puffs directly on the housing of the device, the air inlets must be positioned away from the user's mouth in use in order to ensure a sufficient supply of air is able to enter the device.

The air channel 28 extends around the circumference of the cavity 22 to capture heat lost from the cavity. The air within the air channel 28 is thereby heated prior to passing into the cavity and through the substrate 12. This preheating of the air not only improves the efficiency of the device but also ensures a more uniform temperature profile within the substrate. The air channel 28 may consist of a plurality of separate channels spaced from one another, or may be configured for force air to flow in a particular pattern around the cavity, but in this example comprises a single longitudinally extending chamber.

A pair of outlet apertures 30 is provided between the air flow channel 28 and the cavity 22 at the distal end of the cavity. Again the number, position and size of the outlet channels may be varied according to the particular operating parameters of the device.

Once the air has entered the cavity 22 it is drawn past the blade shaped heater element through the substrate, where it is further heated and entrains aerosol formed from the substrate. The air flow exits the smoking article through the mouthpiece 24.

In this example, the heater element is a single blade shaped heater, positioned within the substrate 12. Alternatively or in addition one or more heater elements may be provided on the periphery of the cavity, outside of the substrate. In that case the air flow channel is positioned between the heater elements and the outer surface of the housing 10.

Following insertion of a smoking article 102 into the cavity 22, the device of FIGS. 1 and 2 is activated by a user using the user interface 20. Once activated the heater element heats the substrate for a predetermined time period, for example seven minutes. During that time the user may puff on the smoking article to draw air through the device so that aerosol is delivered to the user. The heater is configured to provide continuous heating during the period of operation, regardless of whether a user is puffing on the smoking article. As an alternative, the device may include an airflow sensor and the heater may be configured to heat the substrate only when a threshold level of air flow is passing through the device.

In use, the air flow around the cavity 22 reduces the temperature of the housing in the region of the cavity by several degrees centigrade when compared to air inlets provided through the housing at a distal end of the cavity. This is beneficial as it allows the housing to remain at a temperature that is comfortable for the user to hold.

Figure 4:
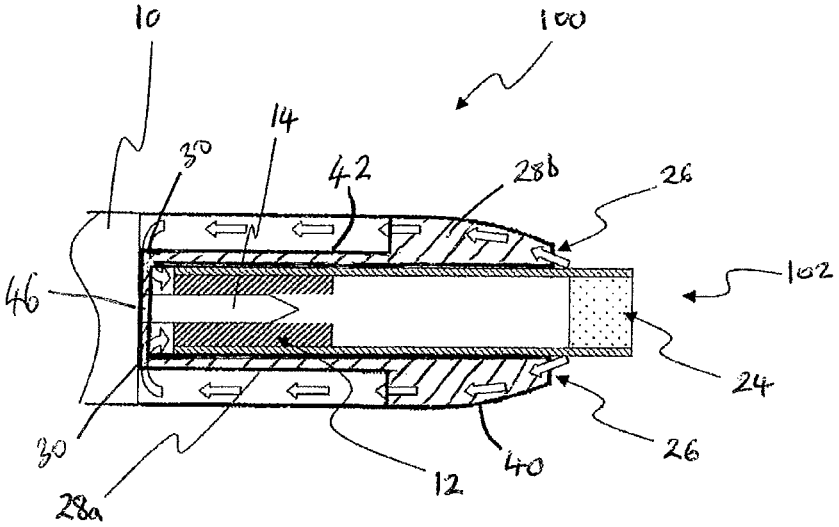
FIG. 4 is schematic cross-section of a second embodiment of a device of the type shown in FIG. 1, showing the air flow path through the device.

The air flow channel(s) in FIG. 2 are within the housing 10. However, alternatively or in addition, it is possible for air channels to be formed between the housing and an inserted substrate. For example, the internal surface of the cavity may include one of more grooves forming the air channel. Alternatively, the air flow channel(s) may be formed in separable portions of the housing. FIG. 4 shows an embodiment in which the air flow channel(s) extend through two separable portions of the housing.

In FIG. 4 the housing comprises two separable portions, a main body 10 and a substrate holder portion 40. The substrate holder portion 40 is shown coupled to the main body 10 in FIG. 4, and forms the proximal end of the device. The substrate holder portion 40 is beneficial for removing the smoking article after use. There is the risk that removing the smoking article from the device by simply pulling on the smoking article will break the smoking article, leaving a portion of it behind in the cavity 22, from which it is difficult to remove.

Figure 5:
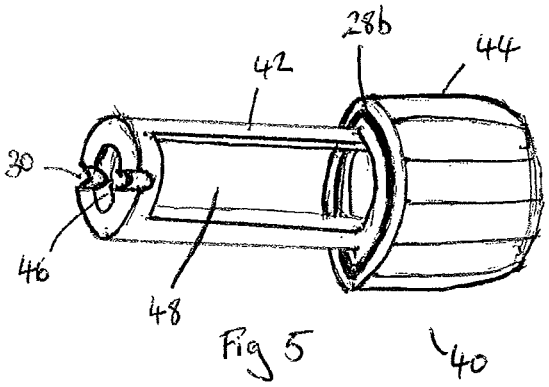
FIG. 5 is a schematic diagram of the substrate extractor element shown in FIG. 4.

FIG. 5 is a schematic view of the substrate holder portion 40 separate from the device. The substrate holder portion has a distal end 42, which is located within the main body 10 in use and in which the aerosol-forming substrate is positioned in use, and a proximal end 44, which forms part of the exterior surface of the housing. The substrate holder portion has a cylindrical bore which defines the cavity 22.

The distal end 42 of the substrate holder portion has an aperture 46 through which the heater element 14 can pass. The distal end may also include windows 48, as shown, to allow direct contact between an aerosol-forming substrate and externally positioned heater elements. Alternatively the distal end of the substrate holder portion may include one or more heater elements.

The proximal end 44 of the substrate holder portion 40 includes air inlets 26 in the manner shown and described with reference to FIG. 3. An air flow channel **28*b* is formed in the proximal end 44 in communication with the inlets 26. The air flow channel 28*b* is configured to match and join with a corresponding air flow channel 28*a* in the main body 10. Grooves 46 formed in the distal end of the substrate holder portion 40 allow air to pass from the air channel 28*a* in the main body to the interior of the cavity 22, through the aperture 46**.

FIGS. 4 and 5 illustrate just one example of separable portions of the housing and an air flow channel that extends within both portions. It should be clear that any combination of housing portions can be used while providing an air flow around the cavity 22 which is drawn through the device by a user puff.

The separable substrate holder portion 40 can be tailored for particular users or particular substrate types. By providing substrate holder portions 40 with different sizes, shapes or numbers of air inlets 26, different resistance to draws can be provided. The smoking article, including the aerosol-forming substrate provides some resistance to draw and different substrates and mouthpieces will provide different resistance to draw. By providing different inlets 26 on the housing, the differences between different smoking articles can be compensated for. Different substrate holder portions may be provided to fit particular substrates. Alternatively, different substrate holder portions may be provided simply to cater for different user preferences.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. An aerosol generating system, comprising:

an aerosol-forming article, comprising an aerosol-forming substrate and a mouthpiece portion for allowing a user to draw air through the substrate;

an aerosol generating device, comprising a housing having proximal and distal ends and comprising at least one external surface and one internal surface, the internal surface defining an open ended cavity at the proximal end of the housing in which the aerosol-forming substrate is received, the cavity having a longitudinal extent between its proximal and distal ends, a heater element within the cavity configured to heat an aerosol-forming substrate received in the cavity, and an air inlet;

a first air flow channel extending from the air inlet to a distal end of the cavity, wherein the first air flow channel extends between the heater element and the external surface of the housing along at least a portion of the longitudinal extent of the cavity; and a second air flow channel extending from the distal end of the cavity to the mouthpiece portion, wherein the heater element is in the form of a pin or blade that extends into the substrate, and wherein a distal end of the first air flow channel and a distal end of the second air flow channel meet at an air outlet positioned around a base of the heater element.

2. The aerosol generating system according to claim 1, wherein the aerosol-forming article and the aerosol generating device together provide a resistance to draw (RTD) of between 80 mm $H_2O$ and 120 mm $H_2O$ through the first and second air flow channels.

3. The aerosol generating system according to claim 2, wherein the aerosol generating device provides greater than 10% of the RTD through the first and second air flow channels.

4. The aerosol generating system according to claim 1, wherein the first air flow channel is positioned between the internal surface and the external surface of the housing.

5. The aerosol generating system according to claim 1, wherein the air inlet is at or close to a proximal end of the cavity.

6. The aerosol generating system according to claim 1, further comprising a plurality of air inlets.

7. The aerosol generating system according to claim 1, wherein the air inlet or plurality of air inlets have a total cross sectional area of between 3 $mm^2$ and 5 $mm^2$.

8. The aerosol generating system according to claim 1, wherein at least a portion of the first air flow channel extends parallel to a longitudinal extent of the heater element.

9. The aerosol generating system according to claim 1, wherein the housing comprises a main body and a substrate holder portion, the substrate holder portion being removable from the main body and comprising at least a portion of the interior wall defining the cavity, wherein the air inlet is formed in the substrate holder portion.

10. The aerosol generating system according to claim 1, wherein the housing comprises a main body and a substrate holder portion, the substrate holder portion being removable from the main body and comprising interior walls defining the cavity, wherein the outlet is formed in the substrate holder portion.

11. The aerosol generating system according to claim 1, wherein the heater element is configured to heat the aerosol-forming substrate continuously during operation of the device.

12. The aerosol generating system according to claim 1, wherein the housing is generally cylindrical and has a maximum diameter of between 10 mm and 20 mm.

13. An aerosol generating device, comprising:

a housing having proximal and distal ends and comprising at least one external surface and one internal surface, the internal surface defining an open ended cavity at the proximal end of the housing in which an aerosol-forming substrate is received, the cavity having a longitudinal extent between its proximal and distal ends;

a heater element within the cavity configured to heat the aerosol-forming substrate received in the cavity;

an air inlet;

a first air flow channel extending from the air inlet to a distal end of the cavity, wherein the first air flow channel extends between the internal surface and the external surface of the housing along at least a portion of the longitudinal extent of the cavity; and a second air flow channel extending from the distal end of the cavity to the proximal end of the cavity, wherein the heater element is in the form of a pin or blade that extends into the substrate, and wherein a distal end of the first air flow channel and a distal end of the second air flow channel meet at an air outlet positioned around a base of the heater element.

14. The aerosol generating device according to claim 13, wherein the device provides a resistance to draw (RTD) of between 5 mm $H_2O$ and 20 mm $H_2O$ through the first and second air flow channels in the absence of the aerosol forming substrate in the cavity.

* * * * *